US010426697B2

(12) United States Patent
Walden et al.

(10) Patent No.: US 10,426,697 B2
(45) Date of Patent: Oct. 1, 2019

(54) COMPACT ELECTRO-MECHANICAL CHEST COMPRESSION DRIVE

(71) Applicant: KONINKLIJKE PHILIPS N.V., Eindhoven (NL)

(72) Inventors: Christopher Walden, Framingham, MA (US); Virginia Higley, Tyngsboro, MA (US); Tyler Douglas Smith, Corvallis, OR (US); Steven Joseph Frankovich, McMinnville, OR (US); Daniel Calvert Canfield, McMinnville, OR (US)

(73) Assignee: Koninklijke Philips N.V., Eindhoven (NL)

( * ) Notice: Subject to any disclaimer, the term of this patent is extended or adjusted under 35 U.S.C. 154(b) by 607 days.

(21) Appl. No.: 15/039,043

(22) PCT Filed: Nov. 24, 2014

(86) PCT No.: PCT/IB2014/066278

§ 371 (c)(1),
(2) Date: May 25, 2016

(87) PCT Pub. No.: WO2015/075691

PCT Pub. Date: May 28, 2015

(65) Prior Publication Data

US 2017/0172845 A1 Jun. 22, 2017

Related U.S. Application Data

(60) Provisional application No. 61/908,242, filed on Nov. 25, 2013.

(51) Int. Cl.
*A61H 31/00* (2006.01)

(52) U.S. Cl.
CPC ... *A61H 31/006* (2013.01); *A61H 2201/0157* (2013.01); *A61H 2201/1215* (2013.01);
(Continued)

(58) Field of Classification Search
CPC ..... A61H 31/006; A61H 2201/149; A61H 2201/5064; A61H 2201/5061;
(Continued)

(56) References Cited

U.S. PATENT DOCUMENTS 3,489,140 A 1/1970 Mullikin
6,129,025 A 10/2000 Minakami
(Continued)

FOREIGN PATENT DOCUMENTS

CN 102090973 A 6/2011
CN 102552015 A 7/2012
(Continued)

*Primary Examiner* — Quang D Thanh

(57) ABSTRACT

A cardio-pulmonary compression device includes a motor (11) having a rotating portion, and a ball nut (12) mounted on the rotating portion and configured to rotate with the rotating portion. A ball screw (13) is received in the ball nut such that rotation on the ball nut advances and/or retracts the ball screw in accordance with a direction of the motor. A pad assembly (15) is coupled to an end portion of the ball screw such that longitudinal motion of the ball screw imparts a compression cycle to a patient.

20 Claims, 6 Drawing Sheets

(52) U.S. Cl.
CPC .... *A61H 2201/149* (2013.01); *A61H 2201/50* (2013.01); *A61H 2201/5061* (2013.01); *A61H 2201/5064* (2013.01)

(58) Field of Classification Search
CPC .... A61H 2201/1215; A61H 2201/0157; A61H 2201/50; A61H 3/00; A61H 2031/001; A61H 2203/0456; A61H 2205/084; A61H 2201/0107; A61H 2201/12; A61H 2201/1207; A61H 2201/1223; A61H 2201/1481; A61H 2201/1619; A61H 2201/1521; A61H 2201/1664
See application file for complete search history.

(56) References Cited

U.S. PATENT DOCUMENTS

| | | | | |
|---|---|---|---|---|
| 6,174,295 | B1 | 1/2001 | Cantrell et al. | |
| 8,007,451 | B2 | 8/2011 | Havardsholm et al. | |
| 8,690,804 | B2 | 4/2014 | Nilsson et al. | |
| 9,328,391 | B1 | 5/2016 | Chang et al. | |
| 9,445,967 | B2 | 9/2016 | Woerlee et al. | |
| 2007/0270724 | A1 | 11/2007 | Havardsholm et al. | |
| 2010/0185127 | A1* | 7/2010 | Nilsson | A61H 31/004 601/41 |
| 2010/0198118 | A1* | 8/2010 | Itnati | A61H 31/004 601/41 |
| 2011/0166490 | A1 | 7/2011 | Woerke et al. | |
| 2012/0238922 | A1* | 9/2012 | Stemple | A61H 31/006 601/41 |
| 2013/0030333 | A1 | 1/2013 | Cicenas et al. | |
| 2015/0119768 | A1* | 4/2015 | Meier | A61H 31/006 601/41 |

FOREIGN PATENT DOCUMENTS

| | | | |
|---|---|---|---|
| CN | 202490161 | U | 10/2012 |
| CN | 202875768 | U | 4/2013 |
| JP | H0217134 | U | 9/1991 |
| JP | 2006320693 | A | 11/2006 |
| WO | 2004058136 | A1 | 7/2004 |
| WO | 2009136831 | A1 | 11/2009 |

* cited by examiner

COMPACT ELECTRO-MECHANICAL CHEST COMPRESSION DRIVE

This application is a national stage application under 35 U.S.C. § 371 of International Application No. PCT/IB2014/066278 filed on Nov. 24, 2014 and published in the English language on May 28, 2015 as International Publication No. WO 2015/075691, which claims priority to U.S. Application No. 61/908,242 filed on Nov. 25, 2013, the entire disclosures of which are incorporated herein by reference.

BACKGROUND

Technical Field

This disclosure relates to cardiopulmonary instruments and more particularly to methods and devices for automatic cardiopulmonary resuscitation (CPR), which include compact features for efficient and ease of usage.

Description of the Related Art

Mechanical cardiopulmonary resuscitation (CPR) compression devices provide many clinical and practical advantages over manual CPR. Per 2010 guidelines from the American Heart Association (AHA), the CPR compression rate should be at least 100 compressions per minute with a minimum depth of 5 centimeters (for adults). Studies have found that manual CPR is frequently performed too slowly and without adequate depth to ensure good perfusion. In addition, even if manual compressions are performed to AHA guidelines, caregivers tire quickly. Mechanical CPR devices provide compressions consistent with AHA guidelines over long periods of time.

A variety of technologies have been applied to develop mechanical CPR devices, each with significant disadvantages in terms of weight, size, portability, and run times. Most current generation CPR devices have switched to electro-mechanically powered compression mechanisms. These devices use battery-powered motors and provide precise control and adjustability of compression rate and depth. However, these first generation electro-mechanical CPR devices are heavy, large, and difficult to set up on the patient.

Electromechanical CPR devices typically weigh about 15 pounds or more. Due to this weight, if the device sits directly on the patient's chest, it will provide a pre-load that will interfere with the efficacy of the CPR compressions. High quality chest compressions include two phases: compression and release. During the compression cycle, compression of the chest in the area of the sternum squeezes the heart chambers so that oxygenated blood flows to vital organs. During the release cycle, the chest expands and the heart chambers refill with blood. If a heavy compression unit sits on the patient's chest, the chest expansion is limited, and therefore the quality of CPR is reduced, i.e., perfusion is reduced because the amount of blood returning to the heart chambers is reduced. Many conventional electromechanical devices have high centers of gravity, which can adversely affect their stability during operation and transport. This can contribute to rocking of the compression device, potentially adversely affecting therapy and/or make it more difficult for the caregivers to operate.

In addition, the size and weight of any portable medical device, especially those used in a pre-hospital and emergency medical services (EMS) environment, can significantly affect the acceptability of the device to the caregiver. Devices such as a portable defibrillator, monitor or an automated CPR device must fit inside the limited storage space of an ambulance or fire truck. In some locations, EMS caregivers must carry these devices, in addition to many other items, up many flights of stairs to reach their patient. Added weight and size slows down caregivers, which in turn may have a negative effect upon the patient's health. Every second counts when the patient has suffered sudden cardiac arrest.

SUMMARY

In accordance with the present principles, a cardio-pulmonary compression device includes a motor having a rotating portion, and a ball nut mounted on the rotating portion and configured to rotate with the rotating portion. A ball screw is received in the ball nut such that rotation of the ball nut advances and/or retracts the ball screw in accordance with a direction of the motor. A pad assembly is coupled to an end portion of the ball screw such that longitudinal motion of the ball screw imparts a compression cycle to a patient.

A cardio-pulmonary compression device includes a motor having a rotating portion and a guide fixture mounted on the motor and forming at least one guide hole therethrough. A ball nut is mounted on the rotating portion and configured to rotate with the rotating portion. A ball screw is received in the ball nut such that rotation of the ball nut advances and/or retracts the ball screw in accordance with a direction of the motor. A pad assembly is coupled to an end portion of the ball screw such that longitudinal motion of the ball screw imparts a compression cycle to a patient. At least one linear guide passes through the guide fixture and is connected to the pad assembly to resist rotation of the motor.

A method for actuating a pad assembly of a compression device includes providing a compression unit having a motor with a rotating portion; a ball nut mounted on the rotating portion and configured to rotate with the rotating portion; a ball screw being received in the ball nut such that rotation of the ball nut advances and/or retracts the ball screw in accordance with a direction of the motor; and a pad assembly coupled to an end portion of the ball screw; activating the motor to provide longitudinal motion to advance the ball screw; and reversing the motor to provide longitudinal motion to retract the ball screw.

These and other objects, features and advantages of the present disclosure will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF EMBODIMENTS

Figure 1:
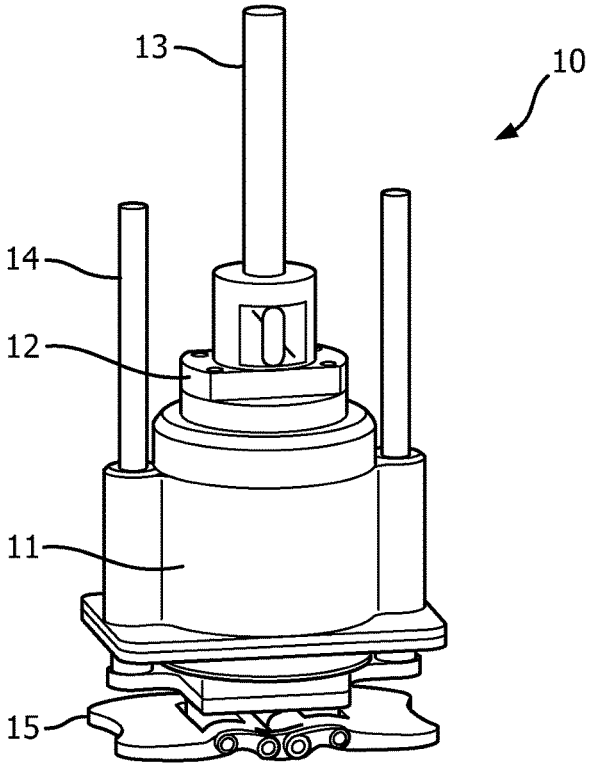
FIG. 1 is a perspective view showing a compression device having a ball nut on an opposite side of a motor from a pad assembly in accordance with one embodiment.

In accordance with the present principles, a compression device includes a compact, lighter weight structure, which makes the device easier to handle, more portable and more efficient. In one embodiment, a frameless electric motor includes a rotor, which is directly affixed to a ball nut. The ball nut, in turn, drives linear motion of a ball screw and a chest compression pad attached to the ball screw. Such embodiments provide a minimum size and/or weight profile possible for an electromechanical chest compression mechanism. The device may be driven by a battery and/or an AC power source and utilizes electronic controls to produce high quality compressions. To avoid pre-loading of the chest, etc., electro-mechanical CPR devices in accordance with the present principles reduce the size and weight of the compression unit.

By separating out the battery, control electronics and user interface into the control unit, the weight of the compression unit may be reduced significantly, and even light enough to sit directly on the patient's chest without a rigid support structure. In accordance with the present principles, a further advantage is provided for minimizing the physical size and weight of an electromechanical drive used in chest compressions, compared to other electro-mechanical drives. In the present embodiments, a compression device may either sit directly upon a patient's chest without a rigid support structure, or the compression device may be employed in conjunction with a separate support structure to support the compression device above the patient's chest.

It should be understood that the present invention will be described in terms of medical instruments; however, the teachings of the present invention are much broader and are applicable to training equipment, and any other instrument that employs automatic compressions. In some embodiments, the present principles are employed in providing compressions for complex biological or mechanical systems. While described in terms of particular mechanical features equivalent mechanical devices or features may also be employed. The elements depicted in the FIGS. may be implemented in various combinations of hardware and software and provide functions which may be combined in a single element or multiple elements.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

Referring now to the drawings in which like numerals represent the same or similar elements and initially to FIG. 1, a compression device or mechanism 10 is shown in accordance with one illustrative embodiment. The compression device 10 includes a frameless electric motor 11, which may be powered using AC or DC power. The electric motor 11 is configured to drive a ball screw 13, which is guided using a ball nut 12. The ball screw 13 is advanced and retracted in accordance with the motor 11 to deliver compression therapy to a patient. Ball screws 13 are force and motion-transfer devices (power-transmission screws). Ball screws 13 operate like power screws but rolling friction of bearing balls replaces sliding friction. Ball screws 13 may include balls that operate similarly to bearing components. A ball screw assembly is generally made up of four primary elements: a shaft or screw, a ball nut, a ball recirculation system, and bearing balls.

A pad assembly 15 makes contact with the patient. The pad assembly 15 is driven by the ball screw 13, and linear guides 14 assist in providing a stable and controlled motion of the ball screw 13 and the pad assembly 15 during compressions.

In accordance with one embodiment, the frameless electric motor 11 powers the compressions, and a linear ball screw (13)/nut (12) assembly converts the rotary motion of the motor 11 into the linear motion needed to compress the patient's chest. This design provides a number of advantages compared to other electromechanical compression mechanisms. For example, the motor 11 and ball screw 13 with the compression pad 15 are substantially coaxial. This reduces the overall size and width of the compression unit 10. Because of the reduced size, the compression unit 10 may enable the use of a larger motor capable of meeting higher performance requirements. A lower center of gravity and a lower height are provided, permitting a smaller package size, which is capable of being closer to the patient. Gearboxes, belts, and pulleys are not needed and can be eliminated, further reducing the size, improving system efficiency, and eliminating backlash, all of which permit tighter system control. The frameless motor 11, ball screw 13 and ball nut 12 combine to provide a much higher output force than an equivalently-sized linear motor.

The ball nut 12 is affixed to a rotor of the motor 11. Rotation of the ball screw 13 about its central axis is constrained. Linear guides 14 may be employed to provide an anti-rotational constraint and mechanical stability. The compression pad assembly 15 contacts and distributes a compressive force applied to the patient's chest. Force and/or position sensors may be added to facilitate control of the device.

As the rotor of the motor 11 and/or ball nut 12 rotates, the ball screw 13 will move longitudinally along a major axis of the ball screw 13. This motion applies compression to the patient's chest. Once the desired compression depth is reached, the motor 11 reverses direction, which lifts the pad assembly 15 off the chest to permit reperfusion. This cycle is repeated to provide continuous automated CPR.

As depicted in FIG. 1, the ball nut 12 is located on top of the motor 11 opposite the pad assembly 15. One advantage of this configuration is that the center of gravity is low, but the configuration has a larger height since the ball screw 13 protrudes well above the top of the ball nut 12.

Figure 2:
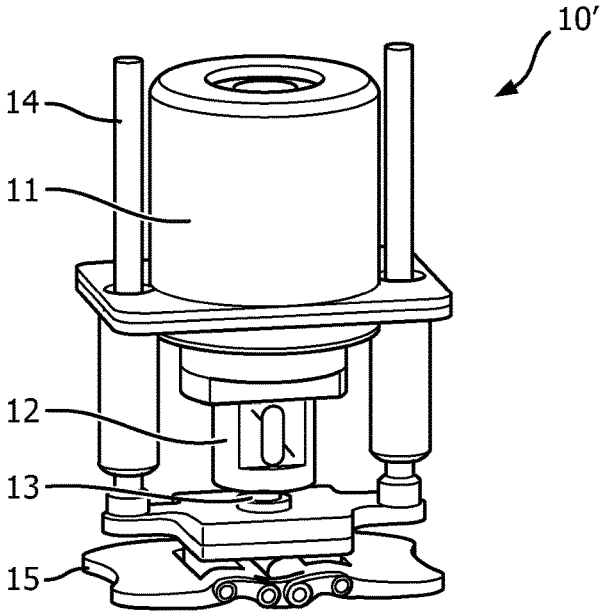
FIG. 2 is a perspective view showing a compression device having a ball nut on a same side of a motor as a pad assembly in accordance with one embodiment.

Referring to FIG. 2, in another embodiment, a compression device or mechanism 10' has a configuration that locates the ball nut 12 below the motor 11. The configuration of FIG. 2 includes the same features and components as the configuration of FIG. 1; however, the motor 11 and a position of the ball nut 12 are reversed. The center of gravity is higher than the configuration of FIG. 1, but the overall height of the drivetrain can be significantly less than that of FIG. 1.

Figure 3:
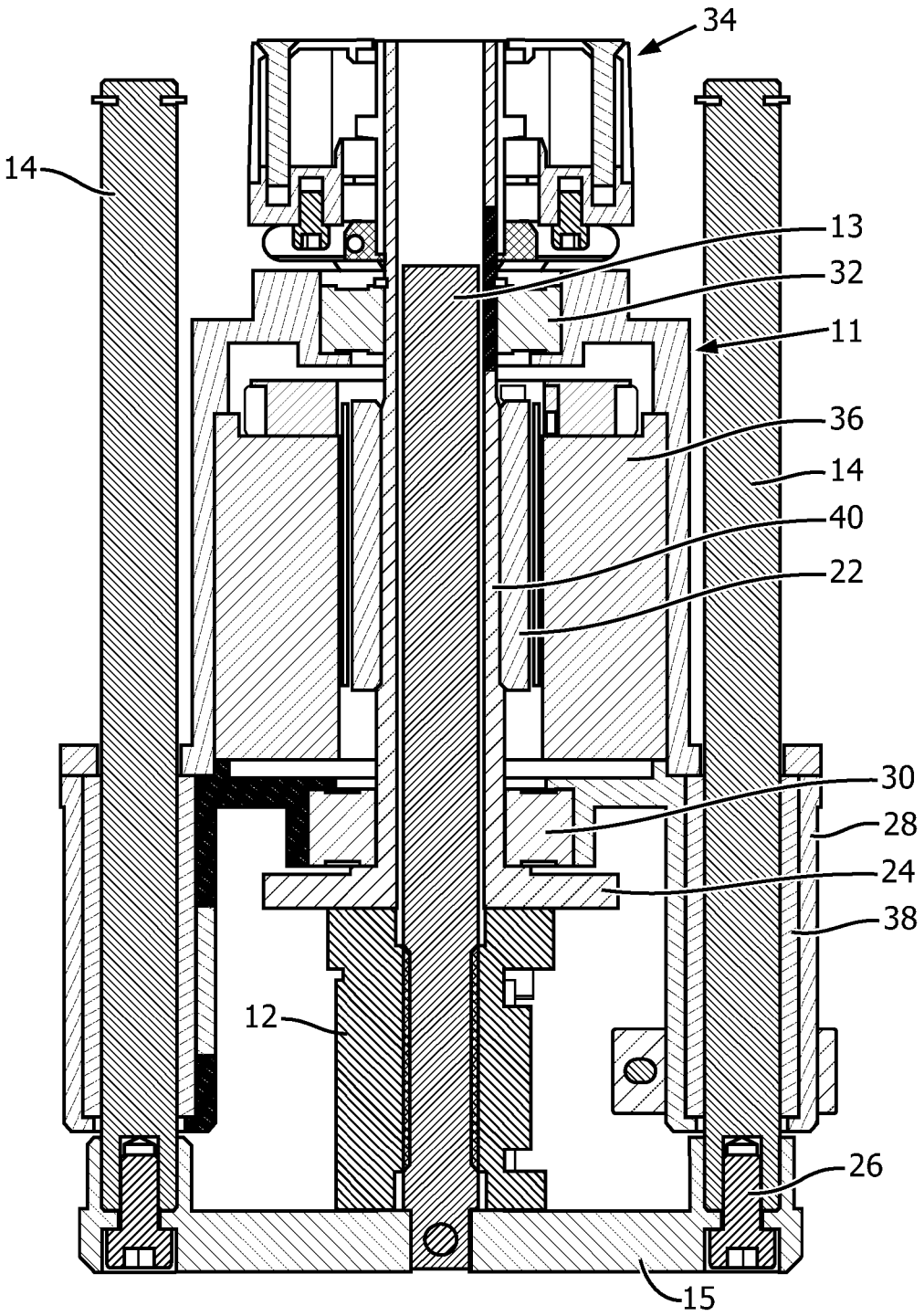
FIG. 3 is a cross-sectional view of the device of FIG. 2 showing a ball screw retracted in accordance with one embodiment.

Referring to FIG. 3, a cross-sectional view of the embodiment of FIG. 2 is shown. It should be understood that the configuration depicted in FIG. 3 is illustrative and that other configurations, components, shapes and sizes of components, etc. may be varied within the scope of the present principles. The motor 11 may include a DC or an AC electrical motor having a magnet or magnets 22 and brushes or coils 36 that are connected with a rotary portion or rotor 40. When energized, the coils 36 rotate the rotor 40. The rotor 40 rotates freely employing one or more bearings 30, 32. The rotor includes a flange 24 to which the ball nut 12 is attached. As the rotor 40 and the flange 24 rotate, the ball nut 12 rotates. The ball nut 12 is engaged with the ball screw 13 using threads or grooves which act as races for ball bearings (not shown). Ball screw 13 sits within the rotor 40 and the ball nut 12. As the ball nut 12 rotates, the ball screw 13 is advanced or retracted (depending on the direction of the motor 11, which has its direction switched as part of a compression cycle). A threaded engagement between the screw 13 and the nut 12 may also be employed.

An end portion of the ball screw 13 is affixed to a pad assembly 15. The pad assembly 15 engages the chest of the patient to perform compression cycles. The pad assembly 15 is attached to linear guides 14. The linear guides 14 are mounted in a guide fixture 28 having low-friction or lubricated spacers or linear bearings 38, which engage the linear guides 14 and assist in permitting smooth motion thereof. The linear guides 14 are connected to the pad assembly 15, e.g., using bolts 26 or other devices. The guide fixture 28 may be included as part of an enclosure or housing with the motor 11. The guide fixture 28 may include lightweight plastic or other suitable materials. The linear guides 14 prevent rotation of the pad assembly 15 and provide stabile and repeatable motion for the ball screw 13.

Other components and configurations may also be employed. For example, a fly wheel, vibration damping mechanism, or rotary encoder 34 may be mounted on the rotor 40 to control vibration or to control motion of the rotating rotor 40.

Figure 4:
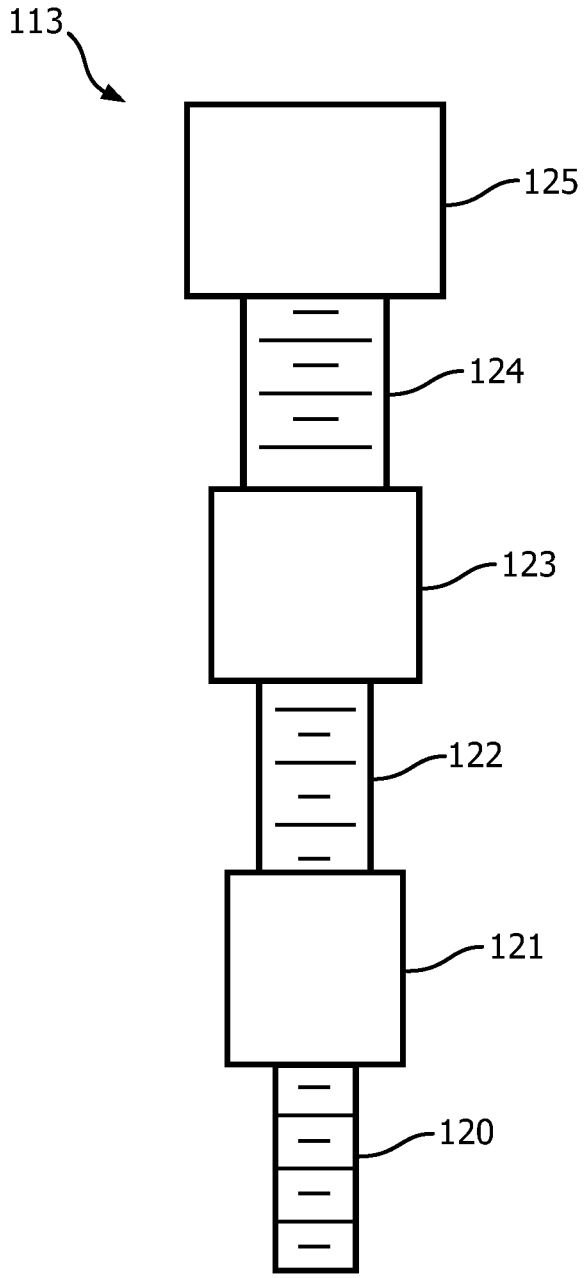
FIG. 4 is a side schematic view of a telescoping ball screw which may be employed in accordance with one illustrative embodiment.

Referring to FIG. 4, in an alternate embodiment, the ball screw 13 may be replaced with a telescoping ball screw 113 or other telescoping device. This embodiment is particularly useful with the configuration of FIG. 1 where a top ball nut 12 is employed and the ball screw 13 extends above the motor 11. The telescoping ball screw 113 can achieve both a low center of gravity and a low overall height. The telescoping ball screw 113 is a complex assembly of several ball screws 120, 122, 124, etc. linked into one device. Each ball nut 121, 123, 125 has the additional function of acting as a bearing for the fixation of the next shaft from the assembly of ball screws 120, 122, 124. Mutual bonded construction of the individual components may secure simultaneous turning and actuation of all ball screws 120, 122, 124 at once, in such a way that multiplication of the stroke per one revolution of the drive is achieved. The telescopic ball screw 113 has the advantage of easy control and positioning. The telescopic ball screw 113 takes advantage of the basic properties of ball screws, in which the highly efficient rolling of balls in the thread profiles of the screw and the nut is used for the transition of the rotary motion into linear motion. Telescopic ball screws provide compact length in comparison with the achieved total actuation.

The screws 120, 122, 124 may have a precision ground or rolled helical groove acting as an inner race. The nuts 121, 123, 125 have internal grooves that act as an outer race. Circuits of precision steel balls recirculate in the grooves between the screws and nuts. Either the screw or nut turns while the other moves in a linear direction. This converts torque to thrust. Other ball-screw components may be needed, such as ball returns and wipers. Ball returns either internally or externally carry balls from the end of their path back to the beginning to complete their circuit. The type of ball return often depends on space constraints and the number of redundant circuits. Wipers keep contaminants out of critical internal ball-screw components and keep lubricants applied to them. Wipers are either internally or externally mounted.

Figure 5A:
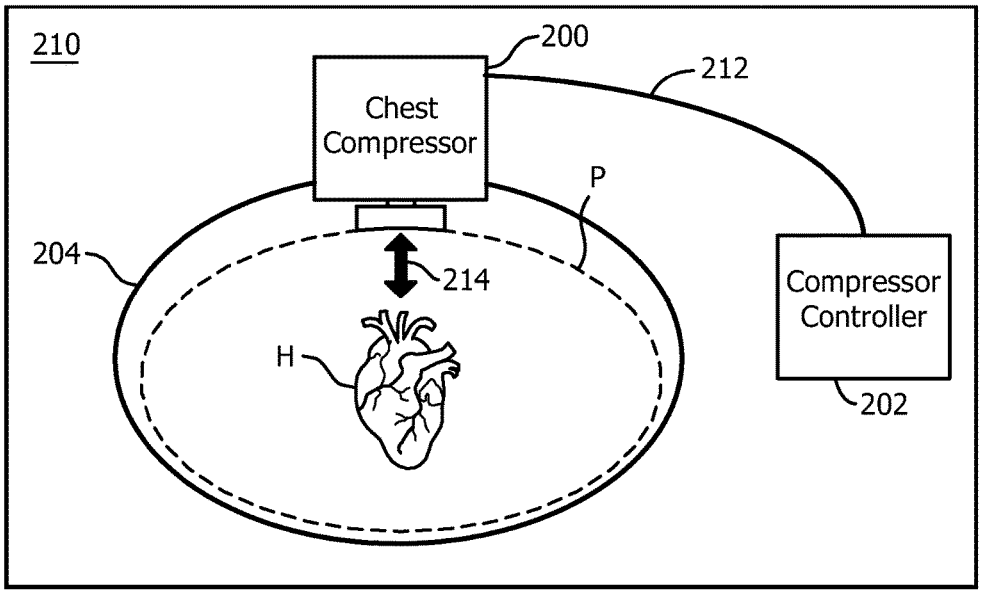
FIG. 5A is a cross-sectional view showing a chest-mounted compression system utilizing the compression mechanism in accordance with one embodiment.
Figure 5B:
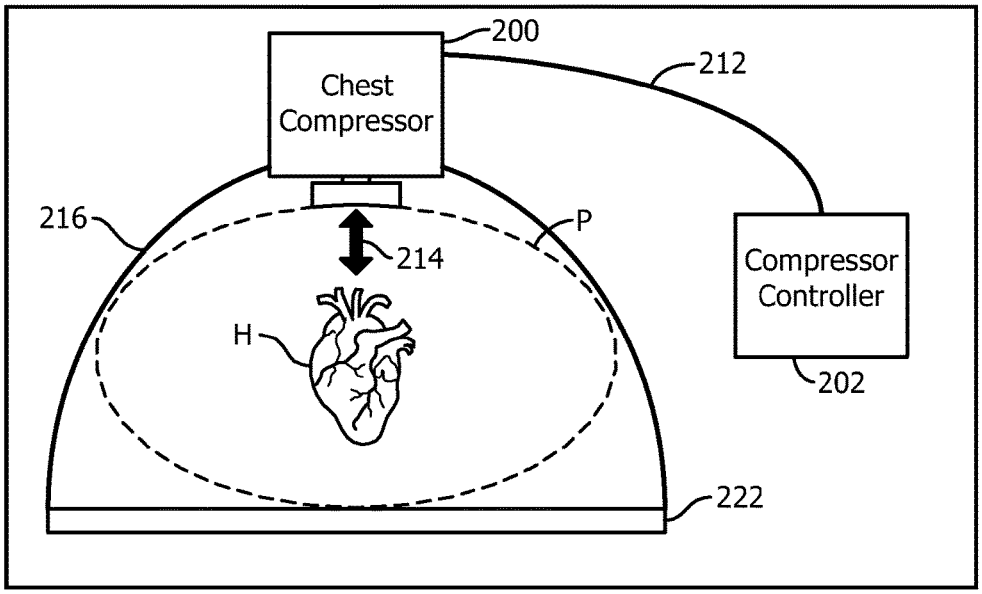
FIG. 5B is a cross-sectional view showing another chest-mounted compression system having a rigid backboard utilizing the compression mechanism in accordance with another embodiment.
Figure 5C:
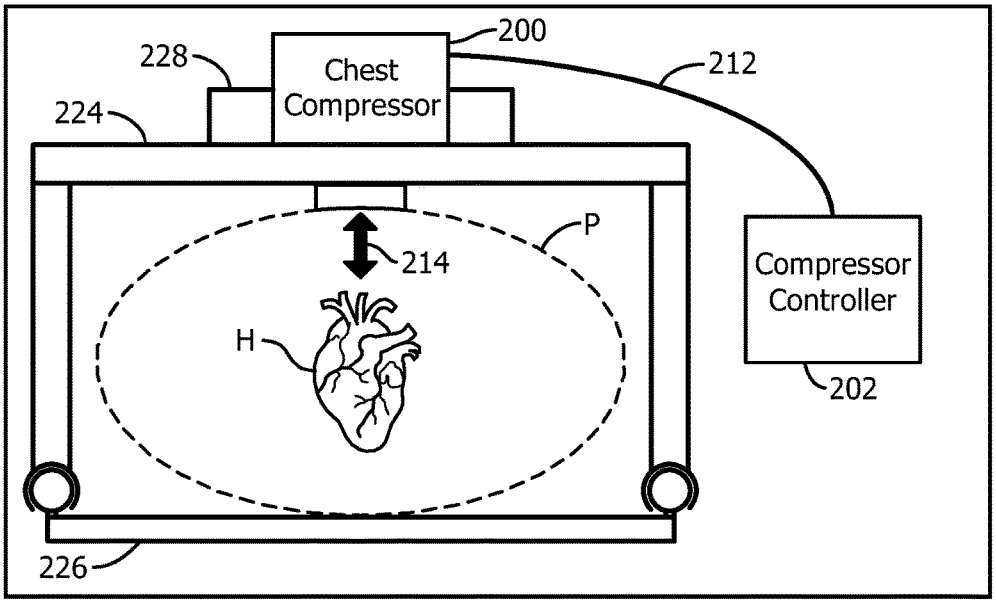
FIG. 5C is a cross-sectional view showing a rigid structure compression system utilizing the compression mechanism in accordance with another embodiment.

Referring to FIGS. 5A-5C, the compression mechanism (10) is mounted inside an enclosure to provide a chest compressor 200. The chest compressor 200 may either sit directly upon a patient's chest without a rigid support structure, or it may be used in conjunction with a separate support structure to support the chest compressor 200 above the patient's chest. FIGS. 5A-5C illustratively shows how the chest compressor 200 may be attached to the patient.

In FIG. 5A, the chest compressor 200 rests directly atop the chest of a patient P shown in a cross-sectional view. The CPR device/system 210 employs the chest compressor 200, a compression controller 202 and a strap 204. In operation, chest compressor 200 is self-supported on a sternum area of the chest of a patient P with strap 204 being wrapped around patient P and coupled to sides of chest compressor 200. Compression controller 202 provides power and control signals to chest compressor 200 via a power/control cable 212 to apply a cyclical compressive force 214 to the chest and heart H of patient P. The compression controller 202 may be located off-patient to reduce the amount of weight applied to the chest of the patient. In this way, a preload is reduced on the patient.

In FIG. 5B, the chest compressor 200 rests directly atop the chest of a patient P. In this embodiment, an alternative strap 216 attaches the chest compressor to a backboard 222 beneath the patient P. The compression controller 202 may be located off-patient to reduce the amount of weight applied to the chest of the patient.

In FIG. 5C, the chest compressor 200 is supported off the patient P by a rigid structure 224, which clamps onto a backboard 226. In this embodiment, to accommodate patients of different sizes, a mechanism 228 is employed to adjust the height of the chest compressor 200. The compression controller 202 may be located off the support structure 224.

Figure 6:
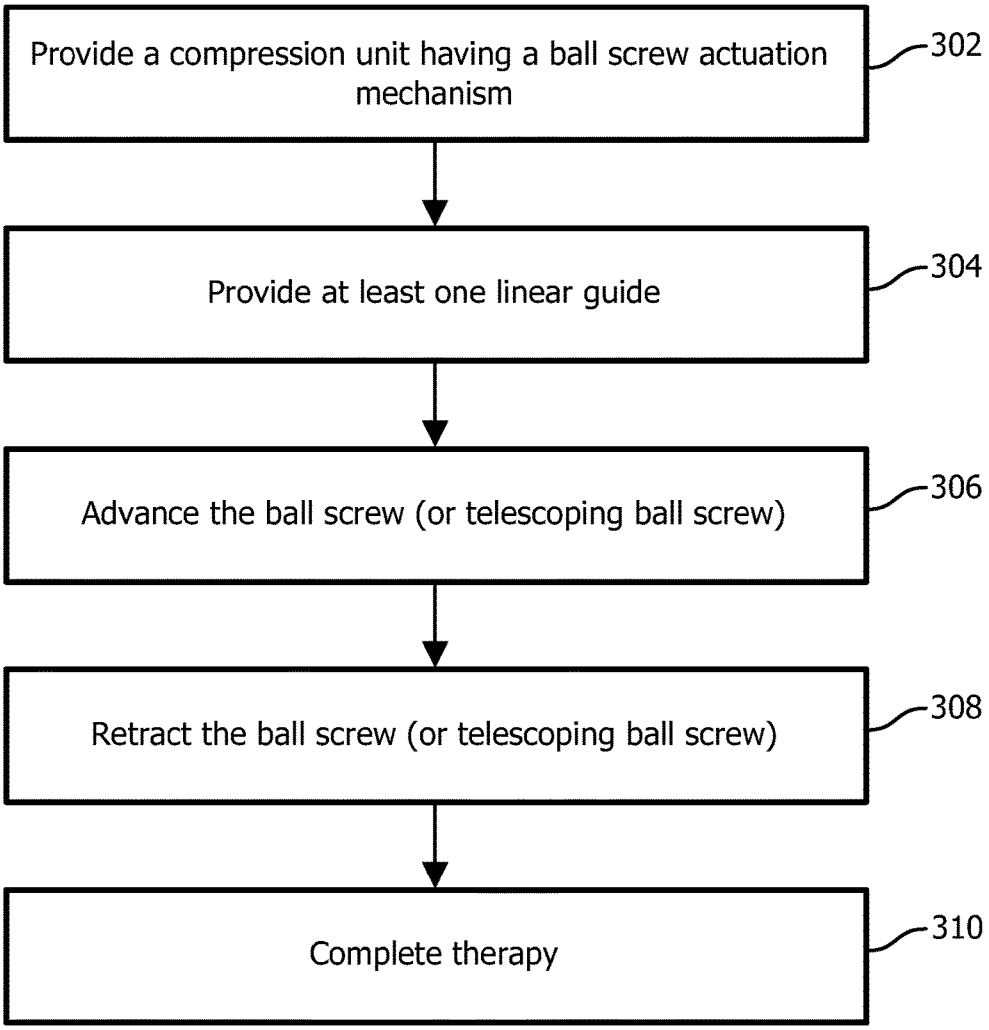
FIG. 6 is a flow diagram showing a method for actuating a pad assembly of a compression device in accordance with an illustrative embodiment.

Referring to FIG. 6, a method for actuating a pad assembly of a compression device is shown in accordance with illustrative embodiments. In block 302, a compression unit having a ball screw actuation mechanism is provided having a motor with a rotating portion, a ball nut mounted on the rotating portion and configured to rotate with the rotating portion and a ball screw being received in the ball nut such that rotation on the ball nut advances and/or retracts the ball screw in accordance with a direction of the motor. A pad assembly is coupled to an end portion of the ball screw. In block 304, at least one linear guide may be connected to the pad assembly to resist rotation of the motor.

In block 306, the motor is activated to provide longitudinal motion to advance the ball screw. The ball screw may include a telescoping ball screw and the longitudinal motion may include telescoping the ball screw to advance the ball screw. In block 308, the motor is reversed to provide longitudinal motion to retract the ball screw. The ball screw may include a telescoping ball screw and the longitudinal motion may include retracting the telescoping ball screw. The ball nut may be on a same side of the motor as the pad assembly or on an opposite side of the motor as the pad assembly. The motion of the ball screw (e.g., distance traveled or stroke, speed, direction, etc.) is controlled by a controller, which controls the motor to perform desired compression cycles. The compression cycles are continued until compression therapy is complete in block 310. The compression unit may be secured or mounted in a plurality of configurations including a strap or rigid structure (See e.g., FIG. 5A-5C).

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function; and e) no specific sequence of acts is intended to be required unless specifically indicated.

Having described preferred embodiments for compact electro-mechanical chest compression drives (which are intended to be illustrative and not limiting), it is noted that modifications and variations can be made by persons skilled in the art in light of the above teachings. It is therefore to be understood that changes may be made in the particular embodiments of the disclosure disclosed which are within the scope of the embodiments disclosed herein as outlined by the appended claims. Having thus described the details and particularity required by the patent laws, what is claimed and desired protected by Letters Patent is set forth in the appended claims.

The invention claimed is:

1. A cardio-pulmonary compression device, comprising:

a motor having a rotating portion;

a ball nut mounted on the rotating portion and configured to rotate with the rotating portion;

a ball screw being received in the ball nut such that rotation on the ball nut advances and/or retracts the ball screw in accordance with a direction of the motor;

a pad assembly coupled to an end portion of the ball screw such that longitudinal motion of the ball screw imparts a compression cycle to a patient.

2. The device as recited in claim 1, wherein the ball nut is on a same side of the motor as the pad assembly.

3. The device as recited in claim 1, wherein the ball nut is on an opposite side of the motor as the pad assembly.

4. The device as recited in claim 1, wherein the ball screw includes a telescoping ball screw.

5. The device as recited in claim 1, further comprising at least one linear guide connected to the pad assembly to resist rotation of the motor.

6. The device as recited in claim 1, wherein the motor includes a direct current or an alternating current motor.

7. The device as recited in claim 1, further comprising a controller configured to control operations of the compression device and being located other than on a chest of a patient.

8. A cardio-pulmonary compression device, comprising:

a motor having a rotating portion;

a guide fixture mounted on the motor and forming at least one guide hole therethrough;

a ball nut mounted on the rotating portion and configured to rotate with the rotating portion;

a ball screw being received in the ball nut such that rotation of the ball nut advances and/or retracts the ball screw in accordance with a direction of the motor;

a pad assembly coupled to an end portion of the ball screw such that longitudinal motion of the ball screw imparts a compression cycle to a patient; and at least one linear guide passing through the guide fixture and being connected to the pad assembly to resist rotation of the motor.

9. The device as recited in claim 8, wherein the ball nut is on a same side of the motor as the pad assembly.

10. The device as recited in claim 8, wherein the ball nut is on an opposite side of the motor as the pad assembly.

11. The device as recited in claim 8, wherein the ball screw includes a telescoping ball screw.

12. The device as recited in claim 8, wherein the motor includes a direct current or an alternating current motor.

13. The device as recited in claim 8, further comprising a controller configured to control operations of the compression device and being located other than on a chest of a patient.

14. A method for actuating a pad assembly of a compression device, comprising:

providing a compression unit having a motor with a rotating portion; a ball nut mounted on the rotating portion and configured to rotate with the rotating portion; a ball screw being received in the ball nut such that rotation of the ball nut advances and/or retracts the ball screw in accordance with a direction of the motor; and a pad assembly coupled to an end portion of the ball screw;

activating the motor to provide longitudinal motion to advance the ball screw; and reversing the motor to provide longitudinal motion to retract the ball screw.

15. The method as recited in claim 14, wherein the ball nut is on a same side of the motor as the pad assembly.

16. The method as recited in claim 14, wherein the ball nut is on an opposite side of the motor as the pad assembly.

17. The method as recited in claim 16, wherein the ball screw includes a telescoping ball screw and the longitudinal motion includes telescoping the ball screw to advance the ball screw.

18. The method as recited in claim 16, wherein the ball screw includes a telescoping ball screw and the longitudinal motion includes retracting the telescoping ball screw.

19. The method as recited in claim 16, further comprising providing at least one linear guide connected to the pad assembly to resist rotation of the motor.

20. The method as recited in claim 16, further comprising securing the compression unit using a strap or rigid structure.

* * * * *